US005328440A

United States Patent [19]

Chen et al.

[11] Patent Number: 5,328,440

[45] Date of Patent: Jul. 12, 1994

[54] CENTRIFUGE BUCKET AND METHOD OF USE

[75] Inventors: Hung-Lung Chen, Highlands Ranch; Hiemi K. Haines, Englewood; Sidney R. Smith, Lakewood, all of Colo.

[73] Assignee: Marathon Oil Company, Findlay, Ohio

[21] Appl. No.: 74,686

[22] Filed: Jun. 9, 1993

Related U.S. Application Data

[63] Continuation-in-part of Ser. No. 817,566, Jan. 7, 1992, abandoned.

[51] Int. Cl.[5] ..... B04B 7/08; B04B 11/00

[52] U.S. Cl. ..... 494/10; 494/17; 494/20; 494/26; 494/30; 494/901

[58] Field of Search ..... 422/72, 101, 102; 436/45, 177, 180; 210/94, 188, 789; 494/16, 10, 17, 18, 19, 20, 21, 22, 23, 27, 31, 32, 33, 35, 37, 900, 901; 73/38, 153

[56] References Cited

U.S. PATENT DOCUMENTS

| | | | |
|---|---|---|---|
| 263,053 | 8/1882 | McCollin | 494/37 |
| 446,248 | 2/1891 | Cooper | 494/10 |
| 934,833 | 9/1909 | Parker | 436/177 |
| 1,428,020 | 9/1922 | Farrington . | |
| 2,692,856 | 10/1994 | Litman | 422/102 |
| 3,487,994 | 1/1970 | Moore | 233/26 |
| 3,561,672 | 2/1971 | Schlutz | 494/20 |
| 3,850,368 | 10/1974 | Boeckeler | 494/19 |
| 3,953,172 | 4/1976 | Shapiro | 422/72 |
| 4,092,113 | 5/1976 | Hardy | 436/177 |
| 4,098,456 | 7/1978 | Bayham | 494/27 |
| 4,194,684 | 3/1980 | Boggs | 494/18 |
| 4,246,882 | 10/1981 | Kobayashi | 494/18 |
| 4,269,718 | 5/1981 | Persidsky | 494/20 |
| 4,296,882 | 10/1981 | Kogayashi | 494/18 |
| 4,342,419 | 8/1982 | Conway | 233/1 A |
| 4,671,102 | 6/1987 | Vinegar | 73/38 |
| 4,753,107 | 6/1988 | Reed | 73/38 |
| 4,798,579 | 1/1989 | Penhasi | 494/18 |
| 4,817,423 | 4/1989 | Christiansen | 73/153 |
| 4,827,761 | 5/1989 | Vinegar | 73/38 |
| 4,959,158 | 9/1990 | Meikrantz | 494/901 |
| 5,005,981 | 4/1991 | Schulte | 494/18 |
| 5,079,948 | 1/1992 | Collins | 73/38 |

*Primary Examiner*—Timothy F. Simone
*Assistant Examiner*—Terrence R. Till

[57] ABSTRACT

A bucket for use in a swinging bucket centrifuge. A core holder is located between two end chambers, with the annular space between the core holder and the bucket sidewall maintaining the chambers in fluid communication. Windows at each end of the bucket allow fluid collections to be monitored. This enables more accurate data to be obtained regarding the effect of fluids of different specific gravity on a fluid saturating a sample. For example, to obtain data allowing a more accurate modeling of reservoir conditions in an oil field impacted by both gas and water displacement, the amount of oil expelled from a rock sample by gas under pressure and temperature conditions simulating those in the reservoir is measured and, after replacing the gas with water, the amount of oil expelled by water under simulated conditions is measured.

16 Claims, 5 Drawing Sheets

CENTRIFUGE BUCKET AND METHOD OF USE

CROSS REFERENCE TO THE RELATED APPLICATION

This application is a continuation-in-part of copending U.S. patent application Ser. No. 07/817,566, filed Jan. 7, 1992, now abandoned.

FIELD OF THE INVENTION

This invention relates to a bucket-type centrifuge adapted for use in studies of core samples of oil-bearing rock formations. More particularly, it relates to a new design of centrifuge bucket which enables data to be obtained in a single experiment for the purpose of studying the effects of both gas and water drainage on an oil-bearing rock formation under reservoir ambient conditions.

BACKGROUND OF THE INVENTION

In order to determine the distribution or effect of fluids in oil-bearing rock formations from test samples it is common to saturate a core sample of the rock with one of the fluids and to submerge the sample in another fluid in a centrifuge chamber. Typically, one of the fluids is oil from the rock formation and the other is water or gas. Because the fluids are immiscible and of different densities, when the centrifuge is rotated some of the fluid in the sample is expelled and replaced by the other fluid. This can be noted and measured through a window provided in the bucket.

When dealing with an oil-bearing formation that is impacted by both gas and water displacement, such as studies involving the effects of water injection in a gas gravity drainage field, it has been necessary to use two different centrifuge buckets in two separate experiments conducted at ambient conditions. Typically, an oil-saturated core sample is placed in a centrifuge bucket and gas is injected into the centrifuge chamber. When the centrifuge is rotated gas will expel some of the oil in the sample. Because the oil has a greater specific gravity than the gas, it collects in the window area at the outer extremity of the bucket. Then the oil-saturated sample, which now contains only the oil which was not expelled during the above experiment, is submerged in a water-filled centrifuge bucket of different design wherein the window area is at the inner extremity of the bucket. Upon rotation of the centrifuge oil is expelled from the sample and, having a lower specific gravity than water, collects in the window area at the inner extremity of the bucket. The results of both experiments then have to be integrated in order to determine the calculated effect of the gas and water in the formation. This is not an entirely reliable procedure, however, because the experiments are not conducted under reservoir conditions, and the actual conditions in the reservoir are often not adequately reflected in a model based on the data collected. This problem is made worse by the fact that the sample loses its gas saturation from the first experiment, thereby not enabling actual reservoir conditions to be reflected during the second experiment.

Another approach to the study of a three phase gas/-water/oil system is to use coreflooding experiments. Such procedures require the use of large cores, in the order of four to five feet long, which have to be flooded at an extremely slow rate, often requiring months to complete the operation.. Moreover, capillary pressure causes oil to be held in the ends of the core. Since such oil would not normally be present in a reservoir, this tends to give misleading results. Coreflooding experiments are therefore not practical as a means of quickly obtaining an accurate model of such a reservoir. Coreflooding experiments are, in addition, quite expensive to carry out.

It would be desirable to be able to obtain data which more realistically reflects actual conditions in a reservoir affected by both gas and water pressure, and to do so rapidly, accurately and economically. Further, it would be desirable to be able to collect such data in a single experiment rather than in two separate experiments.

BRIEF SUMMARY OF THE INVENTION

The centrifuge bucket of the invention is not limited to use in any particular type of centrifuge. For example, it may be designed to be used in a conventional swinging bucket type of centrifuge, wherein the bucket is pivotally mounted on a centrifuge support, or in a centrifuge wherein the buckets are horizontally mounted, as by screw threads, in a central rotating support. In either case the buckets are substantially perpendicular to the rotary shaft of the centrifuge during rotation. Each bucket has two liquid collection chambers, the first being adjacent the inner end of the bucket, or in other words the end closer to the rotary shaft during rotation of the centrifuge, and the second being adjacent the opposite outer end of the bucket. A sleeve or other means for receiving and supporting a sample core is located between the first and second collection chambers so that the sample core is in fluid communication with the collection chambers. In addition, a liquid passageway connects the first and second collection chambers.

With this arrangement liquid expelled from a sample core in a centrifuge operation by a fluid of greater specific gravity than that of the expelled liquid will collect in the first chamber, and liquid expelled from the sample core by a fluid of lesser specific gravity than that of the expelled liquid will collect in the second chamber. A window adjacent each end of the bucket permits collected liquid in each chamber to be monitored.

Preferably, the liquid passageway connecting the first and second collection chambers comprises an annular space between the sample core sleeve and the sidewall connecting the chambers, and the inner end of each bucket comprises a closure cap including means for receiving at least one fluid line so as to be in fluid communication with the first collection chamber.

The bucket lends itself to the laboratory study of oil reservoirs which are affected by both gas and water, such as, for example, studies determining the effect of water injection in a gas gravity drainage field on oil recovery rate, or the effect of gas injection in a water gravity drainage field. Obviously, however, it would also be useful in determining the effect of any fluids of lesser or greater specific gravity than that of the fluid saturating the core sample. Data may be obtained for this purpose by inserting the saturated core sample into the core sleeve of the bucket, introducing a first fluid of low specific gravity into the bucket through a first valve, closing the valve and rotating the centrifuge to expel a portion of the core-saturating fluid from the sample into the second collection chamber referred to above. When gas is utilized as the first fluid and oil is the core saturant, this action simulates gravity drainage in an oil reservoir under the influence of a gas cap drive. The centrifuge is then stopped and a second fluid of high specific gravity is introduced into the bucket through the first valve while allowing the first fluid to escape from the bucket through a second valve which is connected to a back pressure regulator. Oil expelled from the core sample along with the first fluid will flow to the top of the second fluid and can be accounted for in this manner. The valves are then closed and the centrifuge is again rotated to expel an additional amount of the core-saturating fluid from the sample into the first collection chamber referred to above. The data thus produced can be used to more accurately model reservoir gravity drainage.

If desired, the first fluid can be a higher density fluid the core saturant and the second fluid may be less dense. Thus, water gravity drainage in an oil reservoir may be simulated by utilizing water as the first fluid and gas as the second fluid. In such a case, when introducing gas into the bucket while allowing water to escape, any oil produced during this process may be collected and measured.

In either case, the back pressure regulator maintains the same pressure in the bucket when switching from one drive fluid to the other. Thus, to more accurately simulate conditions of the reservoir, gas introduced into the bucket as the low specific gravity fluid is maintained at reservoir pressure and temperature during centrifuging. Similarly, water introduced as the high specific gravity fluid is also maintained at reservoir pressure during centrifuging.

These and other features and aspects of the invention, as well as other benefits, will readily be ascertained from the detailed description of the preferred embodiment described below.

DETAILED DESCRIPTION OF THE PREFERRED EMBODIMENT

Figure 1:
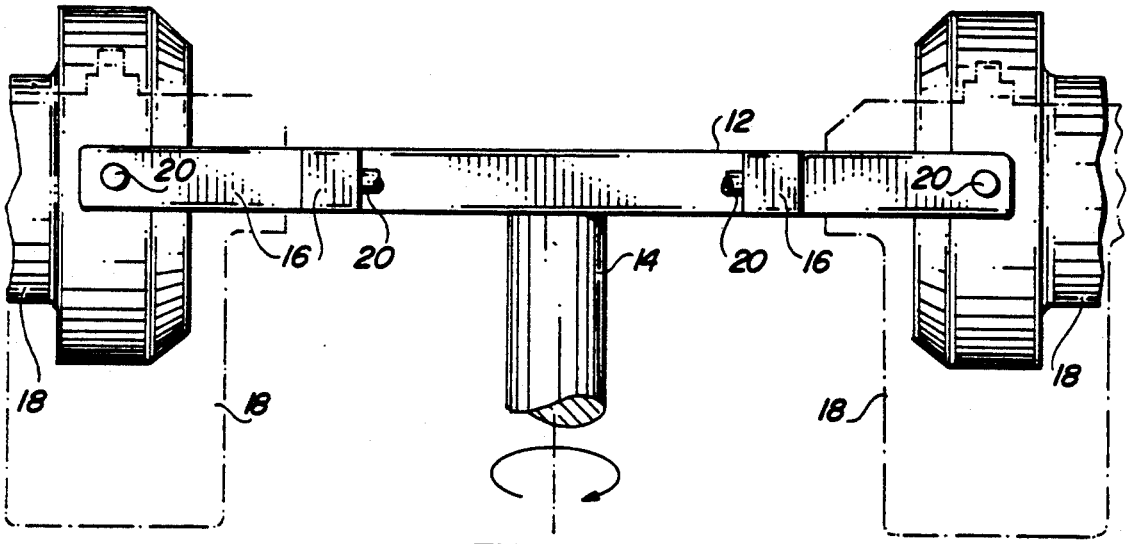
FIG. 1 is a side elevation of a simplified form of swinging bucket centrifuge in which the centrifuge buckets of the present invention are shown in their rotating position, with the bucket closest to the viewer being omitted for the purpose of clarity.
Figure 2:
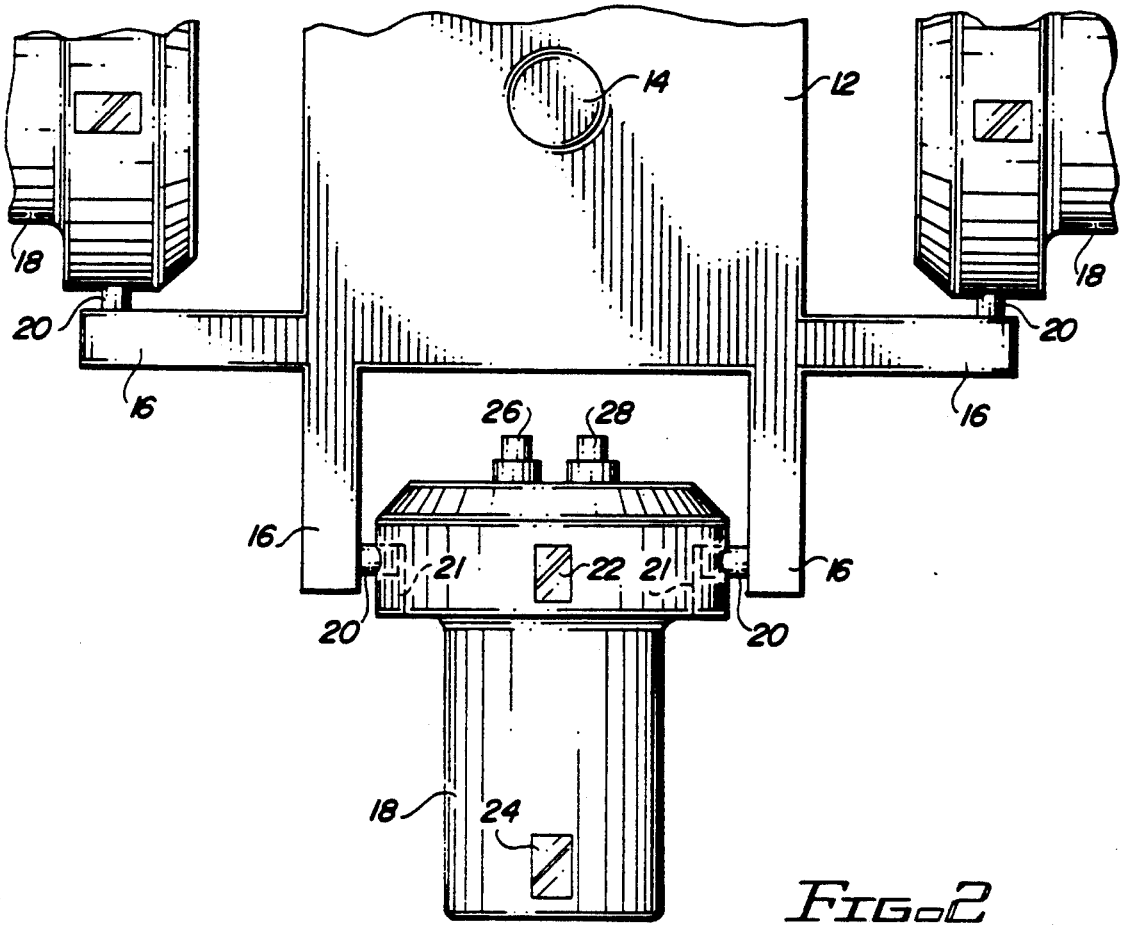
FIG. 2 is a top view of a portion of the centrifuge, showing the omitted bucket of FIG. 1 in its entirety.

Referring to FIGS. 1 and 2, a swinging bucket centrifuge 10 is illustrated which is comprised of a central bucket support 12 attached to a center shaft 14, the support including outwardly extending attachment flanges or brackets 16. While the support 12 is illustrated as having four pairs of mounting brackets for receiving four buckets, the centrifuge may be designed to support a lesser or greater number of buckets. A bucket 18 is attached to each pair of brackets by pivot or trunnion pins 20 which extend inwardly from opposite brackets and are received in suitable openings 21 in the bucket. As shown in FIG. 2, each bucket is of elongated shape compared to conventional buckets, with a viewing window 22 located in the upper portion of the bucket and another viewing window 24 located in the lower portion of the bucket. Each bucket additionally incorporates valves 26 and 28 at the upper end of the bucket which communicate with the bucket interior in a manner described in more detail below.

The shaft 14 is adapted to be rotated by a motor, not shown. Any suitable motor capable of providing the high rotational speeds required in a centrifuging operation may be employed. Speeds in the range of 200 to 20,000 RPM, for example, are normally required in order to expel fluid from a saturated sample at the rates required to generate sufficient data. It will be understood that the buckets in FIGS. 1 and 2 are shown in the horizontal position they assume when the centrifuge is rotating. When the centrifuge is at rest, the buckets hang from their support flanges in the vertical position indicated by dotted lines in FIG. 1. The bottom of the bucket when at rest thus becomes the outer end when spinning and the top of the bucket at rest becomes the inner end when spinning. Since the invention may be incorporated in buckets which are adapted to be supported by means other than by a swinging bucket mounting, it will be understood that the swinging bucket arrangement described is for illustrative purposes only. Buckets incorporating the features of the invention could, for example, be attached directly to the central support, as by screw threads, so that they are maintained in a horizontal position both when spinning and when at rest.

Figure 3:
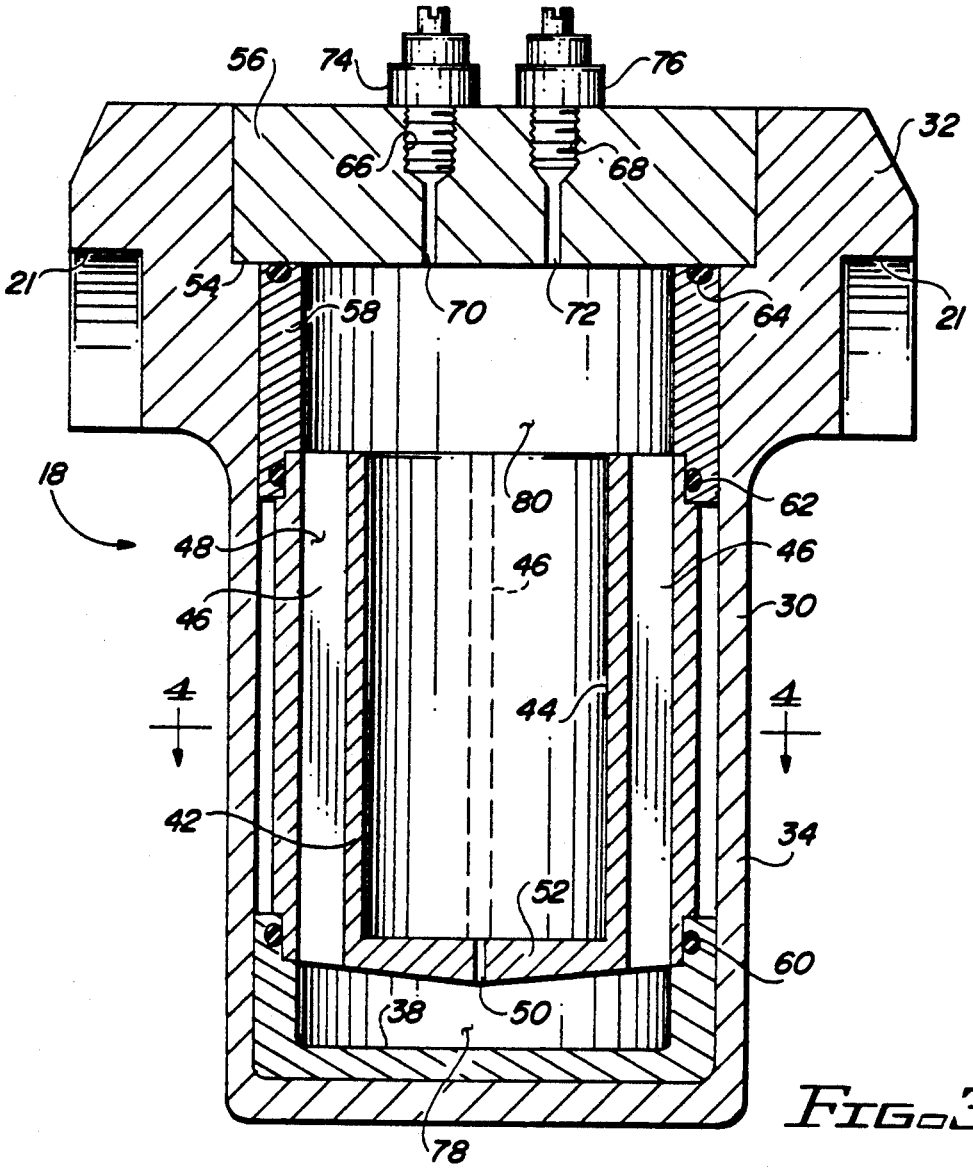
FIG. 3 is an enlarged longitudinal sectional view of the bucket of the invention.
Figure 4:
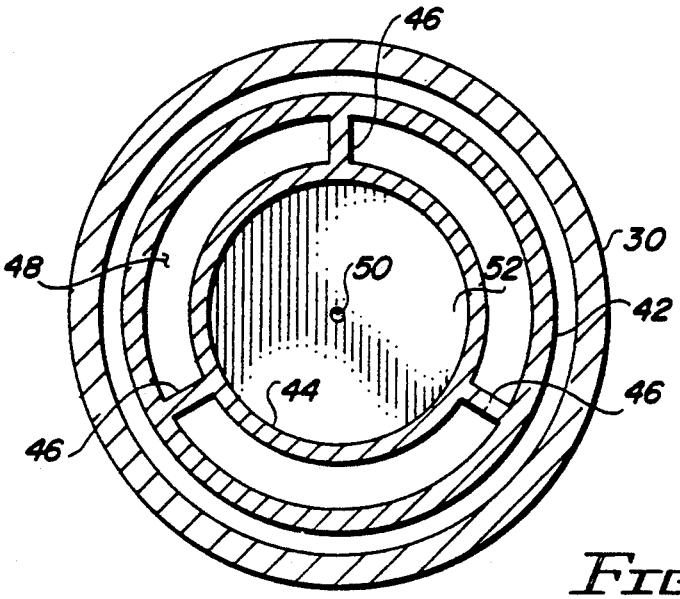
FIG. 4 is a transverse sectional view of the bucket taken along line 4—4 of FIG. 3.

Referring now to FIGS. 3 and 4, the bucket 18 includes an outer casing 30 comprised of a relatively large diameter upper flange portion 32 and a relatively small diameter lower tubular portion 34. The lower end of the tubular portion 34 is closed by an integral end wall 36, and a cup-shaped insert 38 inside the bucket is supported by the end wall 36. Supported on the insert 38 is a tube or cylinder 42 which in turn supports tubular core receptacle or sleeve 44, as by radially spaced ribs or welds 46 or any other convenient means of supporting the core holder coaxially with the cylinder 42 so as to create an annular space 48 therebetween. The core sleeve 44 is open at its upper end and contains an opening or conduit 50 at the midpoint of lower end wall 52 through which liquid expelled from a sample can flow. The end wall 52 is thicker adjacent the conduit 50 than at the ends, so that the end wall slopes away from its midpoint, thereby facilitating the flow of liquid from the end of the bucket toward the annular space 48.

The upper end of the flange portion 32 is counterbored as at 54 in order to receive and support cap 56. The bottom of the cap 56 also engages the upper edge of ring or cylinder 58, and the bottom of the cylinder 58 engages the top of cylinder 42. The upper and lower ends of the cylinder 42 are counterbored so as to fit into counterbores in the lower edge of the cylinder 58 and the upper edge of the insert 38. This arrangement provides for a smooth flow path in the annulus between the core holder 44 and the cylinder 42. O-rings 60 and 62 in the counterbored portions of the insert 38 and the cylinder 58, respectively, prevent leakage at the upper and lower ends of the cylinder 42, and an O-ring 64 in the upper edge of the cylinder 58 prevents leakage between the cylinder 58 and the cap 56.

The cap 56 also contains threaded bores or sockets 66 and 68 extending from the upper surface of the cap, and conduits 70 and 72 which connect the sockets 66 and 68, respectively, to the lower surface of the cap. Positioned in the sockets 66 and 68 are valve bodies 74 and 76, respectively, which incorporate the valves 26 and 28 referred to earlier.

Figure 6:
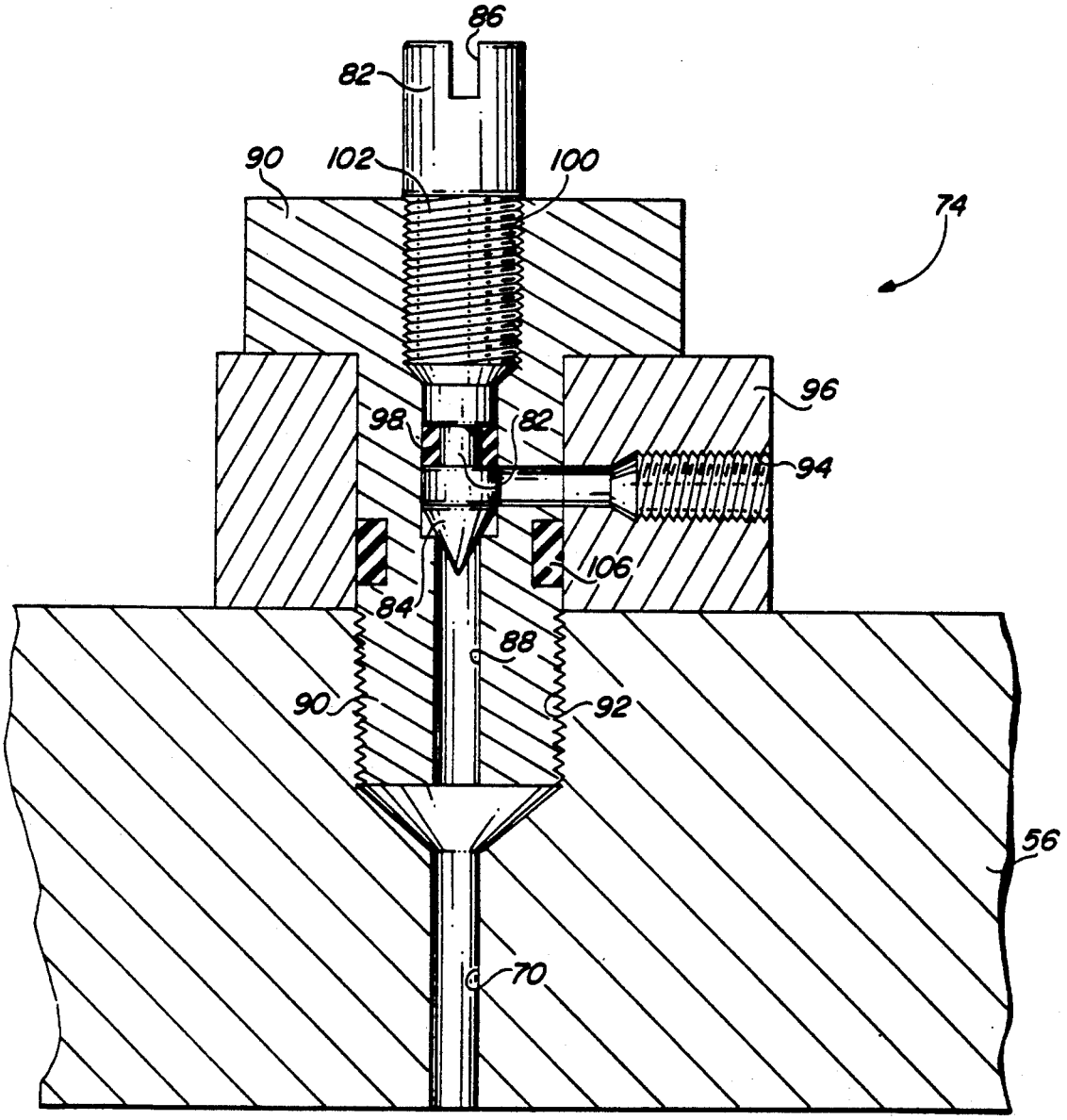
FIG. 6 is an enlarged longitudinal sectional view of a portion of the centrifuge bucket cap showing a valve structure that can be used in connection with the invention.

Any suitable valve design capable of withstanding the high pressures involved and small enough to be utilized with the centrifuge bucket of the invention may be utilized. One suitable valve design is shown in FIG. 6, wherein the valve 74 is a needle valve having a valve stem 82 terminating at its lower end in the needle nose 84 and terminating at its upper end in a slot 86 capable of receiving a screwdriver blade. The needle 84 seats in the upper end of a conduit 88 in the valve nut 90. The valve nut 90 is threaded into threaded bore 92 in the bucket cap 56, which connects with the conduit 70 in the cap. A conduit 94 extending through the valve body 96 connects with the conduit 98 in the valve nut through which the valve stem 82 moves. The upper portion of the conduit 98 is enlarged and threaded, as at 100, to cooperate with the threads 102 on the upper portion of the valve stem 82. O-rings 104 and 106 are positioned on the valve stem and in a groove in the valve nut, respectively, to prevent leakage. In operation, it is merely necessary to back off the valve stem by turning it with a screwdriver in order to open the conduit 88 to the conduit 94, through which driving fluid is moved. To ready the bucket for a centrifuge operation, the valve is closed by turning the valve stem in the opposite direction, disconnecting the source of fluid from the conduit 94 and closing the conduit 94 with a sleeve or other plug.

To assemble the centrifuge bucket components it is merely necessary to slide the insert 38 to the bottom of the bucket, seat the cylinder 42 in place, thereby properly positioning the attached core holder 44 at the same time, and slide the upper ring or cylinder 58 into place until it seats against the counterbored upper end of the cylinder 42. The cap 56 is then pushed into place to form the arrangement shown in FIG. 3. It will be understood that the O-rings 60, 62 and 64 will have been installed in their grooves prior to assembly. The dimensions of the insert 38, the cylinder 58 and the cap 56 are such that they simply slide into place in the bucket shell. Their close tolerances and the centrifugal force of the rotating centrifuge maintain the components in their initial relationship throughout the centrifuge operation. The cap is readily moved into and out of its seat by maintaining the valves in the plugs 74 and 76 open, thereby allowing the pressure within the bucket to be equalized with the outside pressure by means of the open path through the conduits 70 and 72 and the plugs 74 and 76. Although the cylinder 42 is shown as being spaced from the outer shell 30, the wall thickness of the cylinder may be made greater, if desired, causing the cylinder to be closer to the outer shell. Since the cylinder 42 is not exposed to any increased pressure during operation, the wall thickness need only be sufficient to adequately support the sample core sleeve 44, so that any such extra thickness is not needed and preferably is not provided.

The structure described provides for an outer chamber 78 between the bottom end wall 52 of the core sleeve 44 and the bottom wall 36 of the bucket shell 30. An inner chamber 80 is also provided between the top of the core sleeve 44 and the cap 56, with the two chambers being connected by the annular space 48. The window 22 is located in the flange portion 32 to permit the level of liquid in the chamber 80 to be monitored, while the window 24 is located in the bottom or outer end portion of the shell 30 to permit the level of liquid in the chamber 78 to be monitored. This of course requires the cap 58 and the cup 38 to be formed of suitable transparent material so that the level of liquid in the spaces 78 and 80 can be seen through the windows.

Figure 5A:
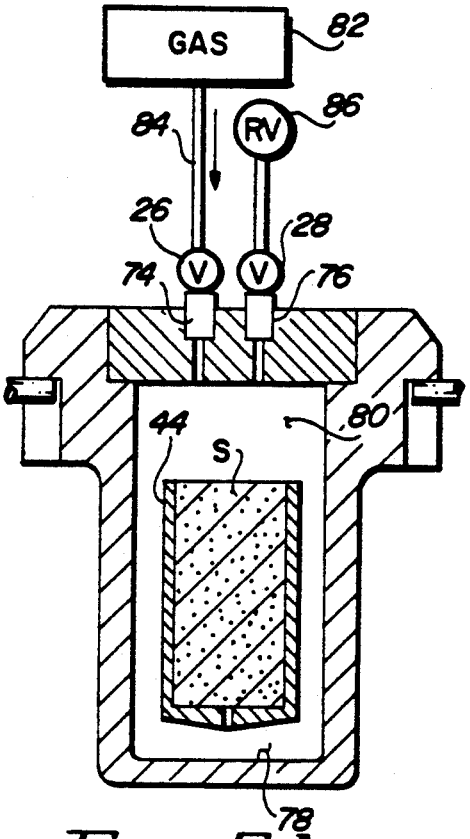
FIG. 5A is a simplified longitudinal sectional view of the bucket of the invention, illustrating the introduction of gas to a core sample where gas is the first drive fluid introduced.
Figure 5C:
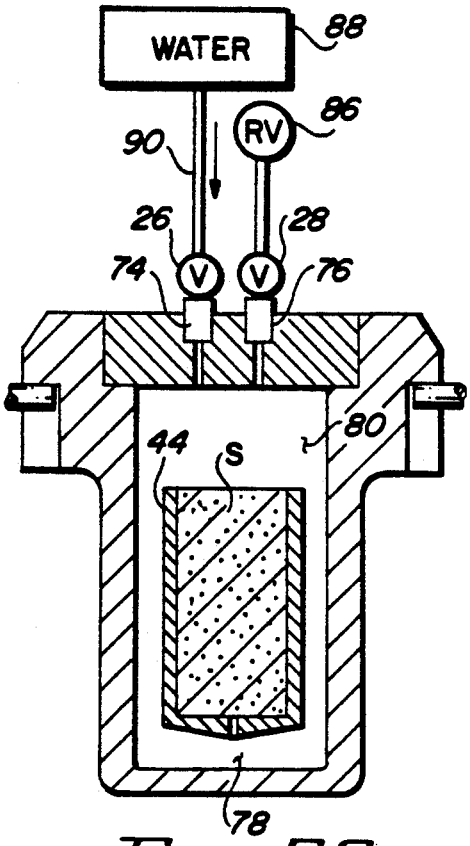
FIG. 5C is a simplified longitudinal sectional view similar to that of FIG. 5A, but illustrating the introduction of water to the core sample of FIG. 5A.
Figure 5B:
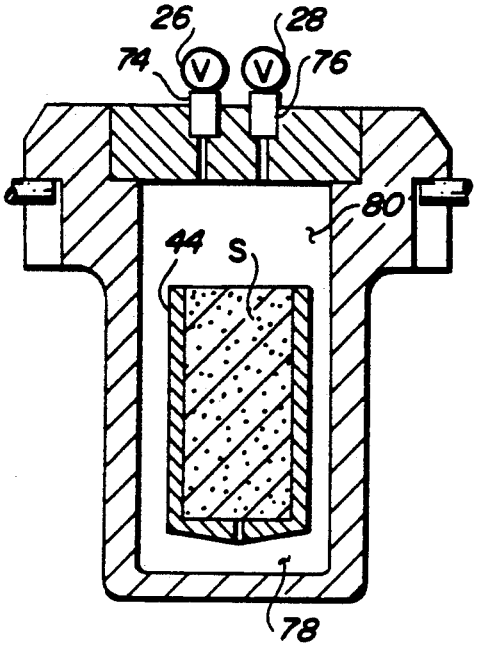
FIG. 5B is a simplified longitudinal sectional view similar to that of FIG. 5A, but showing the bucket as it appears during a centrifuging operation.

Referring now to FIGS. 5A–5C, which are simplified illustrations of the bucket of the invention, showing the relationships of the core sleeve 44 and the essential components of the bucket, a method of using the bucket to determine the effect of water injection in a gas gravity drainage field will be described. A core sample S is placed in the holder and the bucket is assembled as previously described. The core sample will have been saturated with oil from the reservoir in question at connate water saturation. Gas of the type under investigation is supplied from a pressurized gas source 82 through the fluid line 84 to the open valve 26, with the valve 28 open to the back pressure regulator 86 which is maintained in closed condition, until the pressure in the bucket reaches the pressure of the reservoir under study. The gas is equilibrated with the oil at reservoir temperature. The valves 26 and 28 are then closed and the line 84 and back pressure regulator 86 are removed from the valve plugs 74 and 76 as shown in FIG. 5B. The centrifuge is then rotated and oil in the sample is expelled by the gas and collected in the chamber 78 as a result of the oil being of greater specific gravity than the driving fluid. The operation is continued until the amount remaining in the sample corresponds to the saturation level in the reservoir due to gas gravity drainage. The amount collected can be monitored through the window 24.

The centrifuge is then stopped, and a back pressure regulator 86 set at the reservoir pressure is connected to the valve 28. Both valves 26 and 28 are opened and water from a source 88 is then supplied through fluid line 90. This arrangement is illustrated in FIG. 5C. Water enters the bucket, eliminating the gas, and exits through the valve 28. With the pressure of the water being maintained at the desired level by the pressure regulator, both valves 26 and 28 are closed and the conduit 90 and pressure regulator 86 removed. The bucket at this time is again a closed system as it appears in FIG. 5B. At this point, oil may float up through annular space 48 from the chamber 78 to the chamber 80. The centrifuge is again rotated until the point of residual oil saturation is reached, with the oil being recovered in chamber 80 as a result of the oil being of lesser specific gravity than the driving fluid. The collection in this case is monitored through window 22. The data thus collected can be used to provide a more realistic model of the reservoir than is possible by collecting data through the old method of running two separate experiments with separate buckets for the gas phase and the water phase.

Figure 5D:
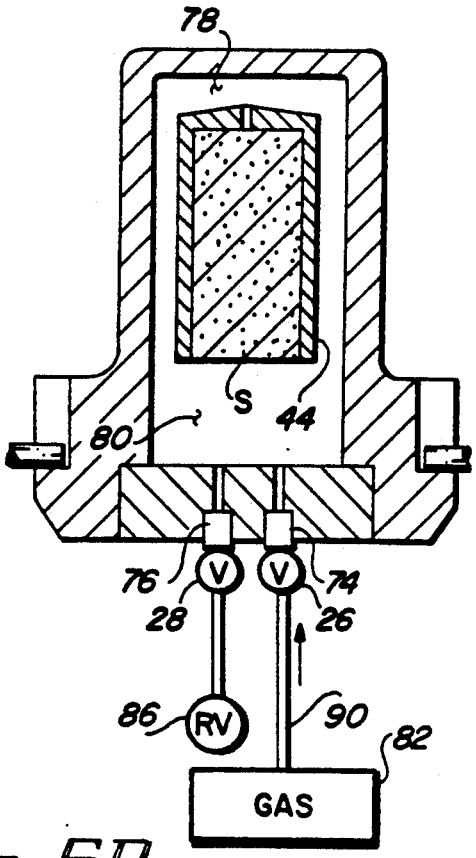
FIG. 5D is a simplified longitudinal sectional view similar to that of FIG. 5A, but showing the bucket in inverted condition as it would be to receive gas injection following the initial introduction of water as the first drive fluid.

The bucket also lends itself to be used to determine the effect on oil recovery of gas injection in a water-invaded oil field. Data is obtained for this purpose by inserting the oil-saturated core sample into the core sleeve of the bucket, introducing a first fluid of high specific gravity, such as water, into the bucket through the valve 26 as shown in FIG. 5C, closing the valve and rotating the centrifuge to expel a portion of the oil from the sample into the collection chamber 80. The centrifuge is then stopped and turned upside down to the position shown in FIG. 5D. A second fluid of low specific gravity, such as gas, is introduced into the inverted bucket through the valve 26 while allowing the first fluid to drain down from the bucket through the valve 28. The centrifuge is then again turned to upright position. The valves 26 and 28 are then closed and the centrifuge is again rotated to expel an additional amount of fluid from the sample into the collection chamber 78. The data thus collected can be used to more accurately model reservoir gas/oil and water/oil drainage.

Although the bucket has special utility in enabling the experiment outlined above to be run, it will be appreciated that its usefulness is not limited to this particular experiment but may be employed to determine relationships in any three-phase fluid system where the driving fluids are of lesser and greater specific gravity, respectively, than that of the saturating fluid. It is also possible within these parameters to test more than one fluid of the same order of density in the bucket of the invention. For example, a first gas can be used as a driving fluid, followed by a second gas, followed by a liquid of higher specific gravity. Another possible test procedure is to first introduce a high density driving fluid such as water, followed by another high density liquid, such as water which has been altered in some manner from the first driving fluid, as for example by including a different amount of a modifier such as a different surfactant solution.

Figure 7:
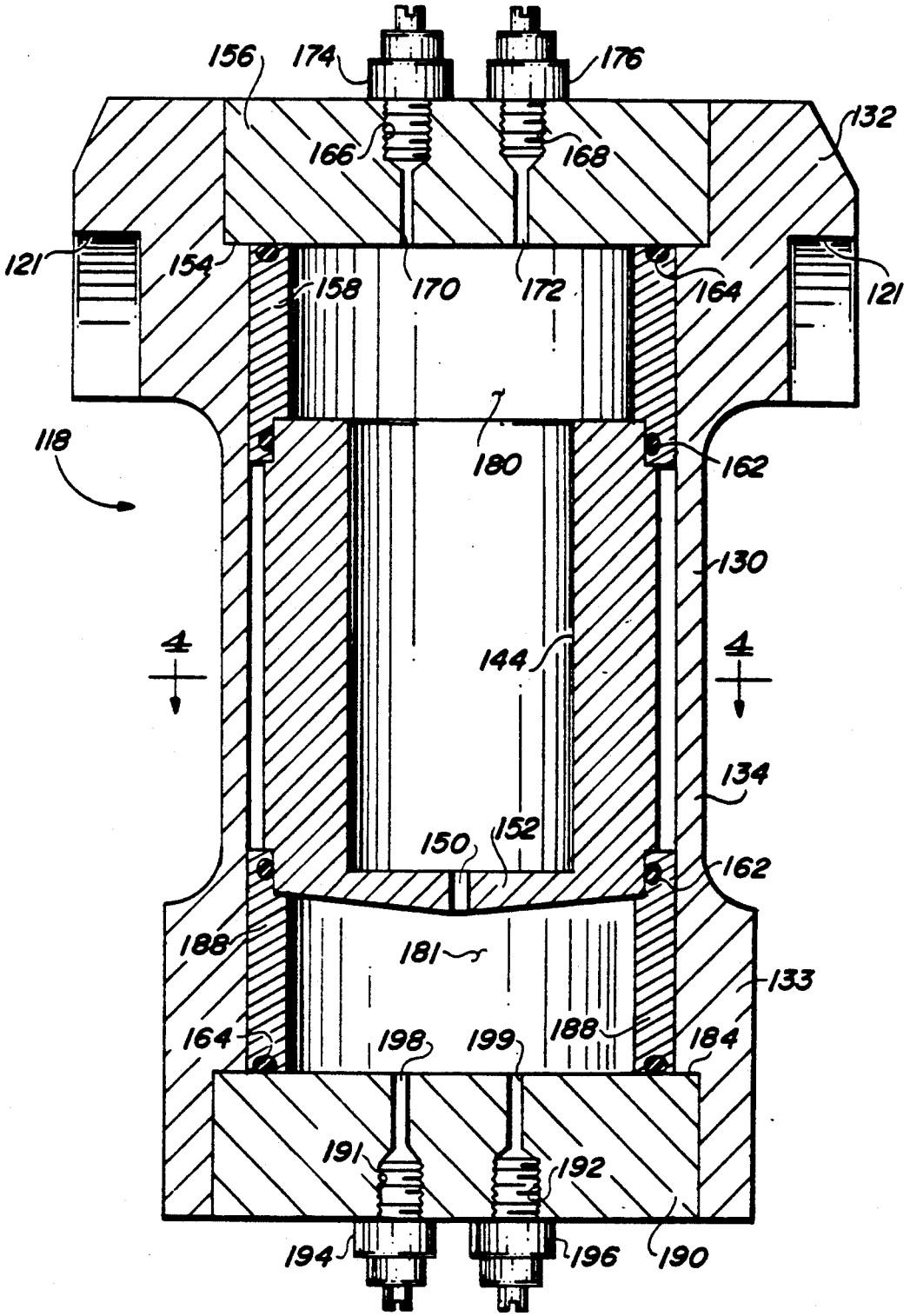
FIG. 7 is an enlarged longitudinal sectional view of another embodiment of the bucket of the invention.

Another embodiment of the bucket of the present invention is illustrated generally as 118 in FIG. 7 and includes an outer casing 130 which is comprised of a first flange portion 132, a second flange portion 133, and a tubular portion 134. First flange portion 132 is provided with openings 121 to attach the bucket to a bracket by means of pivot or trunnion pins 20. The outer end of first flange portion 132 is counterbored as at 154 in order to receive and support cap 156. Cap 156 also engages an end surface of first ring or cylinder 158, while the other end surface of cylinder 158 engages the top of a generally tubular core receptacle or sleeve 144. A first chamber 180 is defined within the interior of first ring or cylinder 158 and is bounded at one end by cap 156 and at the other end by sleeve 144 and the core sample which is inserted therein. Core sleeve 144 has an end wall 152 which is constructed with an opening or conduit 150 proximate the center thereof through which liquid expelled form a sample can flow. End wall 152 is thicker adjacent conduit 150 than at the perimeter thereof so as to define a slope which facilitates the flow of liquid initially passing through conduit 150 away form such conduit. Core receptacle or sleeve 144 also engages an end surface of second ring or cylinder 188. The outer end of second flange portion 133 is counterbored as at 184 in order to receive and support second cap 190. Cap 190 also engages an end surface of second ring or cylinder 188. A second chamber 181 is defined within the interior of second ring or cylinder 188 and is bounded at one end by cap 190 and at the other end by end wall 152 of core sleeve 144. O-rings 162 and 164 are positioned so as to prevent leakage between core receptacle or sleeve 144 and first and second rings or cylinders 158, 188 and between first and second rings or cylinders 158, 188 and caps 156, 190.

Cap 156 contains threaded bores or sockets 166, 168 extending from the upper surface of the cap, and conduits 170, 172 which connect sockets 166, 168, respectively, to the lower surface of the cap. Positioned in the sockets 166, 168 are valve bodies 174, 176, respectively, which incorporate the valves 26, 28, referred to earlier. In a similar manner, cap 190 also contains threaded bores or sockets 191, 192 extending from the upper surface of the cap, and conduits 198, 199 which connect sockets 191, 192, respectively, to the lower surface of the cap. Positioned in the sockets 191, 192 are valve bodies 194, 196, respectively, which incorporate valves 26, 28 as described above. Assembly of this embodiment of the bucket of the present invention will be readily apparent to a skilled artisan in view of the assembly previously described with respect to embodiment illustrated in FIG. 3.

Each bucket 118 is provided with viewing windows 22 and 24. Window 22 is located in the upper portion of the bucket as illustrated in FIG. 2 to permit visual observation of first chamber 180. Window 24 is located in the lower portion of the bucket, e.g. in second flange portion 133, to permit visual observation of the second chamber 181.

A method of using the embodiment of the bucket illustrated as 118 to determine the effect of water injection in a gas gravity drainage field will be described. A core sample which has been saturated with oil from the reservoir in question at connate water saturation is placed inside sleeve 144 which in turn is loaded into the outer casing 130. O-rings 162 and 164 are mounted in cylinder 158, and the cylinder is placed inside the outer casing 130 to engage the end surface of sleeve 144. Cap 156 is secured in place, engaging the end surface of cylinder 158. The first chamber 180 is and the second chamber are simultaneously filled with gas of the type under investigation from a common pressurized gas source. Chamber 180 is supplied with gas via an open valve 26 within valve body 174 and conduit 170, while chamber 181 is supplied with gas via an open valve 26 within valve body 194 and conduit 198. Valves 28 within valve bodies 176 and 196 are open to a common pressure regulator 86 (not illustrated in FIG. 7) which is maintained in a closed position until the pressure in bucket 118 reaches the pressure of the reservoir under study. The gas is equilibrated with the oil at reservoir temperature. All valves 26 and 28 are then closed and the back pressure regulator and all lines connecting valves 28 thereto and any lines connecting valves 26 with the pressurized gas source are removed from the bucket. The centrifuge is then rotated and oil in the sample is expelled by the gas and collected in the second chamber 181 as a result of oil being of greater specific gravity than the driving fluid. The operation is continued until the amount of oil remaining in the sample corresponds to the saturation level in the reservoir due to gas gravity drainage. The amount of oil collected can be monitored through the window 24.

The centrifuge is then stopped and a back pressure regulator 86 (not illustrated in FIG. 7) which is set at the reservoir pressure is connected to the valves 28 within valve bodies 176 and 196. Both valves 26 within valve bodies 174 and 194 and valves 28 within valve bodies 176 and 196 are opened and water from a source 88 (not illustrated in FIG. 7) is supplied through valves 26 and conduits 170 and 198 into chamber 180 and 181, respectively, thereby eliminating the gas from chamber 180 which exits through conduit 172 and valve 28 and gas and oil from chamber 181 which exits through conduit 199 and valve 28. It is preferred to invert the bucket at least once during this procedure to ensure that substantially all the oil and gas present in chamber 181 is displaced by water. With the pressure of the water being maintained at the desired level by the pressure regulator, both valves 26 and 28 are closed and the back pressure regulator and any lines connecting valves 26 with the water source are removed from the bucket. The centrifuge is again rotated until the point of residual oil saturation is reached, with the oil being recovered in chamber 180 as a result of the oil being of lesser specific gravity than the driving fluid. The collection in this case is monitored through window 22. As previously mentioned, the data thus collected can be used to provide a more realistic model of the reservoir than is possible by collecting data via the old method of running two separate experiments with separate buckets for the gas phase and the water phase.

Bucket 118 of this embodiment also lends itself to be used to determine the effect on oil recovery of gas injection in a water-invaded oil field. A core sample which has been saturated with oil form the reservoir in question is placed inside sleeve 144 which in turn is loaded into the outer casing 130. O-rings 162 and 164 are mounted in cylinder 158, and the cylinder is placed inside the outer casing 130 to engage the end surface of sleeve 144. Cap 156 is secured in place, engaging the end surface of cylinder 158. Valves 28 within valve bodies 176 and 196 are open to a common pressure regulator 86 (not illustrated in FIG. 7). Both valves 26 within valve bodies 174 and 194 are opened and water from a common source 88 (not illustrated in FIG. 7) is supplied through valves 26 and conduits 170 and 198 to simultaneously fill chambers 180 and 181, respectively, while air escapes through conduits 172 and 199 and valves 28. As previously described, it is preferred to invert the bucket at least once during this procedure to ensure that substantially all the air present in chamber 181 is displaced by water. All valves 26 and 28 are then closed and the back pressure regulator and any lines connecting valves 26 with the water source are removed form the bucket. Bucket 118 is then loaded into the centrifuge and spun. While the bucket is spinning, water from the first chamber 180 displaces some of the oil in the core, and the oil enters chamber 180. The contact between the oil and the water in chamber 180 can be viewed through the chamber window 22. After spinning, the bucket 118 is removed from the centrifuge. Valves 26 in valve bodies 174 and 194 are connected to a gas line and valves 28 in valve bodies 176 and 196 are connected to a water receptacle. The valves 26 and 28 are opened, and gas enters chamber 181 via valve 26 and conduit 198 while water and oil exit chamber 180 via conduit 172 and water exits chamber 181 via conduit 199. It is again preferred to invert the bucket at least once during this procedure to ensure that substantially all the water and oil present in chamber 180 is displaced by gas. Valves 26 and 28 are then closed and disconnected form the gas line and the water receptacle. The bucket is reloaded into the centrifuge and spun again. While the bucket is spinning, the gas in chamber 181 displaces water and oil in the core, and the water and oil enter chamber 181. The fluid levels in chamber 181 can be viewed through window 24 while the bucket 118 is spinning. The centrifuge is then stopped and the bucket 118 is removed. The data thus collected can be used to more accurately model reservoir gas/oil and water/oil drainage.

It will now be apparent that the ability of the invention to permit use of a single bucket instead of switching buckets to gather data for studies of core samples allows the same gas saturation in the sample under continuing pressure prior to displacement with a higher density fluid. This will be understood by those skilled in the art to improve the accuracy of the data due to the ability to maintain simulated reservoir conditions. Further, as indicated previously, the invention results in a distinct advantage over the use of coreflooding experiments by minimizing the capillary end effect which exists in the coreflooding sample but not in the reservoir.

Tests can be conducted through a wide range of temperatures by heating the centrifuge. Temperatures up to 250°, for example, can readily be achieved, enabling reservoir conditions to be simulated. The invention also contemplates the use of light to heavy oil as the saturant, as reservoir conditions dictate.

Although a specific bucket design has been disclosed which is simple to load and assemble and which is highly functional, it will be understood that other designs which provide for the core sample sleeve to be located so as to provide a clear flow path connecting the inner and outer collection chambers can be employed. Further, it should be understood that changes to other features and aspects which do not affect the overall basic function and concept of the invention may be made by those skilled in the art without departing from the spirit and scope of the invention, as defined by the appended claims.

What is claimed is:

1. In a centrifuge having a rotary shaft, bucket support means connected to the shaft and a plurality of buckets mounted on the support means so as to be substantially perpendicular to the shaft during rotation thereof in a centrifuging operation, each bucket including an inner end and an outer end, the inner end being closer to the rotary shaft during rotation thereof than the outer end, the improvement comprising:

first and second liquid collection chambers in each bucket, the first chamber being adjacent the inner end of the bucket and the second chamber being adjacent the outer end of the bucket;

sample core support means between the first and second collection chambers, the interior of the sample core support means being in fluid communication with the collection chambers; and a liquid passageway, separate from the interior of the sample core support means, connecting the first and second collection chambers;

whereby liquid expelled from a sample core in a centrifuge operation by a fluid of greater specific gravity than that of the expelled liquid will flow through said liquid passageway and collect in the first chamber, and liquid expelled form the sample core by a fluid of lesser specific gravity than that of the expelled liquid will collect in the second chamber.

2. The improvement of claim 1, wherein the liquid passageway connecting the first and second collection chambers comprises an annular space between the sample core support means and a sidewall connecting the first and second chambers.

3. The improvement of claim 1, including a window adjacent each end of each bucket located so as to permit collected liquid in each chamber to be monitored.

4. The improvement of claim 1, wherein the inner end of each bucket comprises a closure cap, the closure cap including means for connecting at least one fluid line thereto.

5. The improvement of claim 4, wherein the closure cap includes a conduit extending between said connecting means and the first collection chamber.

6. A centrifuge bucket for use in a swinging bucket centrifuge, comprising:

a sidewall connected to a bottom end and an upper end;

a first liquid collection chamber in the bucket adjacent the upper end thereof and a second liquid collection chamber adjacent the lower end thereof;

sample core support means between the first and second collection chambers, the interior of the sample core support means being in fluid communication with the collection chamber; and a liquid passageway, separate from the interior of the sample core support means, connecting the first and second collection chambers;

whereby liquid expelled from a sample core in a centrifuge operation by a fluid of greater specific gravity than that of the expelled liquid will flow through said liquid passageway and collect in the first chamber, and liquid expelled form the sample core by a fluid of lesser specific gravity than that of the expelled liquid will collect in the second chamber.

7. The centrifuge bucket of claim 6, wherein the liquid passageway is an annular space between the sample core holder and the sidewall.

8. The centrifuge bucket of claim 7, wherein the sample core support means and the sidewall are cylindrical in shape.

9. The centrifuge bucket of claim 6, including a window adjacent each end of the bucket, the windows being located so as to permit collected liquid in each chamber to be monitored.

10. The centrifuge bucket of claim 6, wherein the upper end of the bucket comprises a closure cap including means for connecting two fluid lines thereto, the cap further including a conduit connecting each fluid line connecting means to the first collection chamber.

11. The centrifuge bucket of claim 10, wherein the sample core support means includes an end wall adjacent the second chamber, said end wall of the sample core support means having an opening therethrough to permit flow of liquid expelled form a sample.

12. A centrifuge bucket for use in a swinging bucket centrifuge, comprising:

an upper end;

a bottom end;

a sidewall connected to said bottom end and said upper end;

a first liquid collection chamber in the bucket adjacent said upper end;

first means for the controlled introduction of fluid into and the controlled removal of fluid from said first liquid collection chamber;

a second liquid collection chamber in the bucket adjacent said lower end;

second means for the controlled introduction of fluid into and the controlled removal of fluid from said second liquid collection chamber; and sample core support means positioned between said first and said second collection chambers for supporting a sample core, the interior of the sample core support means being in fluid communication with said first and said second liquid collection chambers, whereby liquid which is present in said sample core and which is expelled from said sample core in a centrifuge operation by a fluid of greater specific gravity than that of the expelled liquid will collect in said first liquid collection chamber and liquid which is present in said sample core and which is expelled from said sample core by a fluid of lesser specific gravity than that of the expelled liquid will collect in said second liquid collection chamber, said upper end being closer to the axis of rotation of said centrifuge operation than said bottom end.

13. The centrifuge bucket of claim 12 including a window adjacent each end of the bucket, the windows being located so as to permit collected liquid in each chamber to be monitored.

14. The centrifuge bucket of claim 12 wherein said first means comprises a first fluid passageway through said upper end and a first valve positioned within said first fluid passageway for the controlled introduction of fluid into said first liquid collection chamber and a second fluid passageway through said upper end and a second valve positioned within said second fluid passageway for the controlled removal of fluid from the first liquid collection chamber.

15. The centrifuge bucket of claim 12 wherein said second means comprises a first fluid passageway through said lower end and a first valve positioned with said first fluid passageway for the controlled introduction of fluid into said second fluid passageway and a second fluid passageway through said lower end and a second valve positioned within said second fluid passageway for the controlled removal of fluid from the second liquid collection chamber.

16. The centrifuge bucket of claim 12, wherein the sample core support means includes an end wall adjacent the second chamber, said end wall having an opening therethrough to permit flow of liquid expelled from a sample.

* * * * *

UNITED STATES PATENT AND TRADEMARK OFFICE

CERTIFICATE OF CORRECTION

PATENT NO. : 5,328,440

DATED : July 12, 1994

INVENTOR(S) : Hung-Lung Chen, Heimi K. Haines, and R. Smith

It is certified that error appears in the above-identified patent and that said Letters Patent are hereby corrected as shown below:

| | |
|---|---|
| Col. 7, line 63: | Delete "form" and insert --from--. |
| Col. 7, line 67: | Delete "form" and insert --from--. |
| Col. 9, line 35: | Delete "form" and insert --from--. |
| Col. 10, line 68: | Delete "form" and insert --from--. |
| Col. 11, line 38: | Delete "form" and insert --from--. |
| Col. 11, line 61: | Delete "form" and insert --from--. |

Signed and Sealed this

Twenty-fourth Day of January, 1995

*Attest:*

Bruce Lehman

BRUCE LEHMAN

*Attesting Officer*

*Commissioner of Patents and Trademarks*